US009278294B1

(12) United States Patent
Rider

(10) Patent No.: US 9,278,294 B1
(45) Date of Patent: Mar. 8, 2016

(54) TIRE TREAD ATTACHMENT FOR USE ON A TOY VEHICLE

(71) Applicant: Michael Chad Rider, Myrtle Beach, SC (US)

(72) Inventor: Michael Chad Rider, Myrtle Beach, SC (US)

( * ) Notice: Subject to any disclaimer, the term of this patent is extended or adjusted under 35 U.S.C. 154(b) by 261 days.

(21) Appl. No.: 13/953,839

(22) Filed: Jul. 30, 2013

(51) Int. Cl.
*B60C 11/02* (2006.01)
*A63H 17/26* (2006.01)

(52) U.S. Cl.
CPC ..... *A63H 17/26* (2013.01)

(58) Field of Classification Search
CPC ..... B60C 11/02
USPC ..... 152/209.1; 446/448, 465, 470
See application file for complete search history.

(56) References Cited

U.S. PATENT DOCUMENTS 3,224,483 A * 12/1965 Gross et al. ..... 152/187
3,387,894 A * 6/1968 Louik ..... 301/64.701
3,730,594 A * 5/1973 Zbikowski ..... 301/64.701
3,843,202 A * 10/1974 Lacerte ..... 301/64.701
4,193,639 A * 3/1980 Pauly et al. ..... 301/35.61
4,870,736 A * 10/1989 Kacalieff ..... 29/894.31
4,940,445 A * 7/1990 DesPortes ..... 446/465
5,186,676 A * 2/1993 Morton ..... 446/465
7,032,980 B2 * 4/2006 Herbert et al. ..... 301/64.707
D538,738 S * 3/2007 Miller et al. ..... D12/574
7,694,705 B2 * 4/2010 Yokobori ..... 152/176
8,037,911 B2 * 10/2011 Morris ..... 152/323
8,348,285 B2 * 1/2013 Arendt et al. ..... 280/29
8,689,845 B2 * 4/2014 Morris ..... 152/323
2004/0063384 A1 * 4/2004 Hui ..... 446/465
2007/0068613 A1 3/2007 Byrne et al.
2011/0048820 A1 3/2011 Harris
2013/0081743 A1 4/2013 Coghill, Jr.

* cited by examiner

*Primary Examiner* — Jeffrey J Restifo
(74) *Attorney, Agent, or Firm* — Thomas Frost

(57) ABSTRACT

A band is mountable on tires of a child's toy vehicle to provide additional traction for the vehicle. The band has an outer panel with radially outwardly depending treads to engage with the land surface and raised traction supports on an inner panel to engage with the surface of the wheels of the toy vehicle. The band has grasping tabs integrally formed on a peripheral edge to pull the band onto the tires.

1 Claim, 3 Drawing Sheets

TIRE TREAD ATTACHMENT FOR USE ON A TOY VEHICLE

BACKGROUND OF INVENTION

The present invention relates to a band for mounting on the wheels of a child's vehicle for additional traction.

While tire traction bands for battery-powered toy vehicles for children are available, the bands are inefficient in covering a sufficient surface area of the tire to provide adequate traction and the bands need to be snugly placed in an annular groove formed in the tire surface. The present invention easily slips over the plastic wheels present in toy vehicles using grasping tabs and has raised prominences formed on an inner panel to grip against the wheel.

SUMMARY OF THE INVENTION

The general purpose of the present invention, which will be described subsequently in greater detail, is to provide a new and improved attachment for mounting on the wheels of a child's vehicle.

To attain this, the present invention comprises a band of elastomeric material having an outer panel with radially outwardly depending treads on an outer circumference of the outer panel to engage with the surface. On a lower panel of the band is a plurality of raised traction supports to engage with the surface of the wheels of the toy vehicle.

The band has grasping tabs integrally formed on the peripheral edge. The tabs are used to pull the band onto the tires. The tabs have a marked border that allows the tabs to be cut and removed from the band after installation.

It is an object of the present invention to provide a detachable band mounted on the tires of a child's toy vehicle to provide additional traction in a muddy environment and to cover and repair damaged tires.

It is also an object of the present invention to provide traction support means on the inner panel of the band to grip the surface of the tires and provide a countervailing force to the treads on the outer panel.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
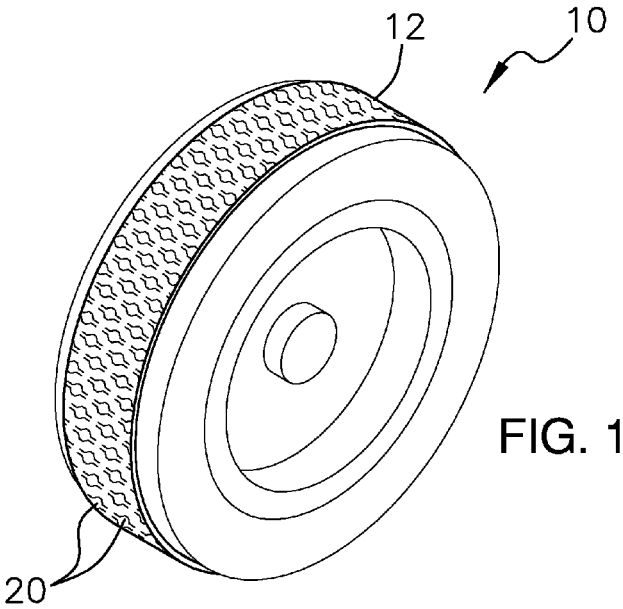
FIG. 1 is a perspective view of the present invention mounted on a tire of a child's toy vehicle.
Figure 2:
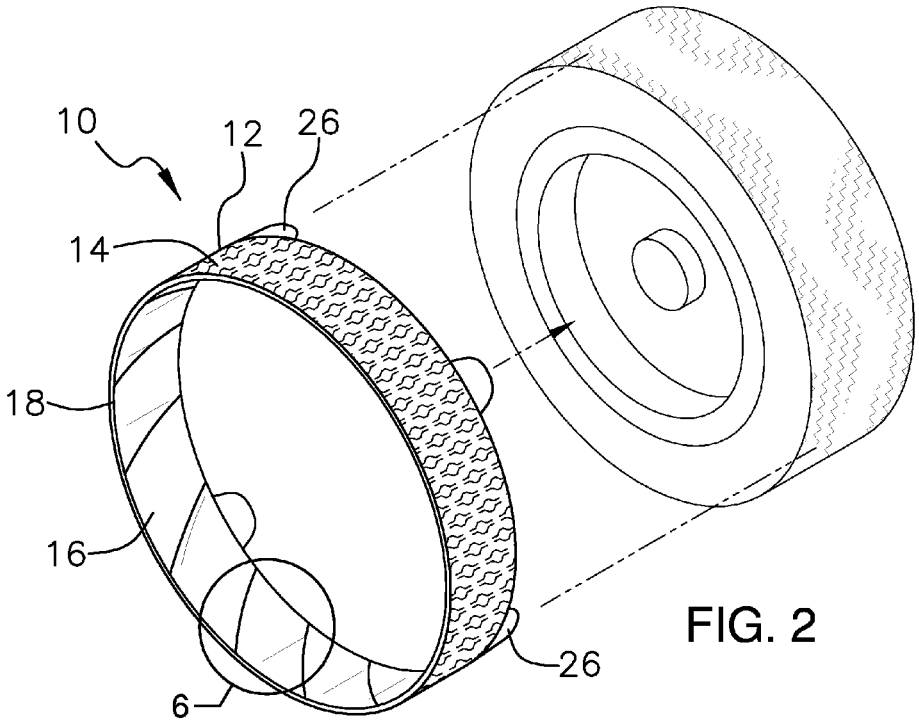
FIG. 2 is an exploded view of the invention removed from the tire.
Figure 3:
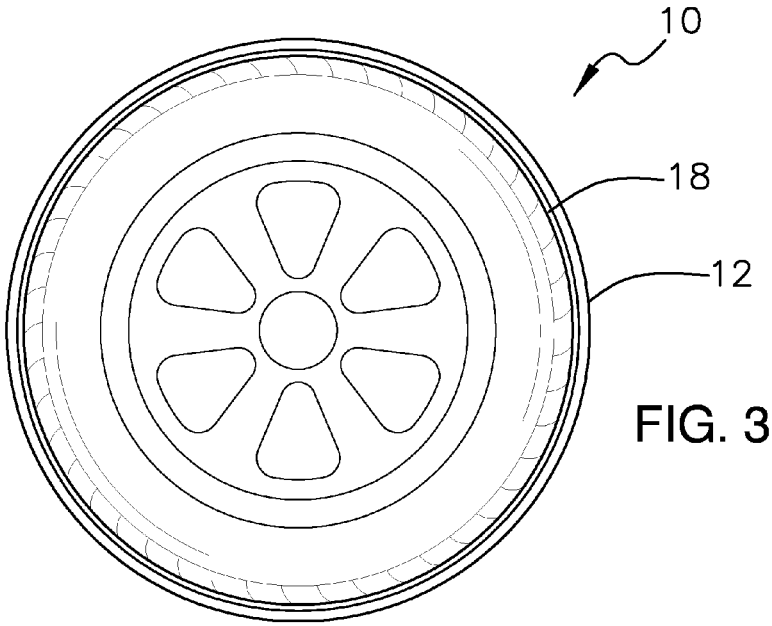
FIG. 3 is a side view of the invention mounted on the tire of the child's toy vehicle.
Figure 4:
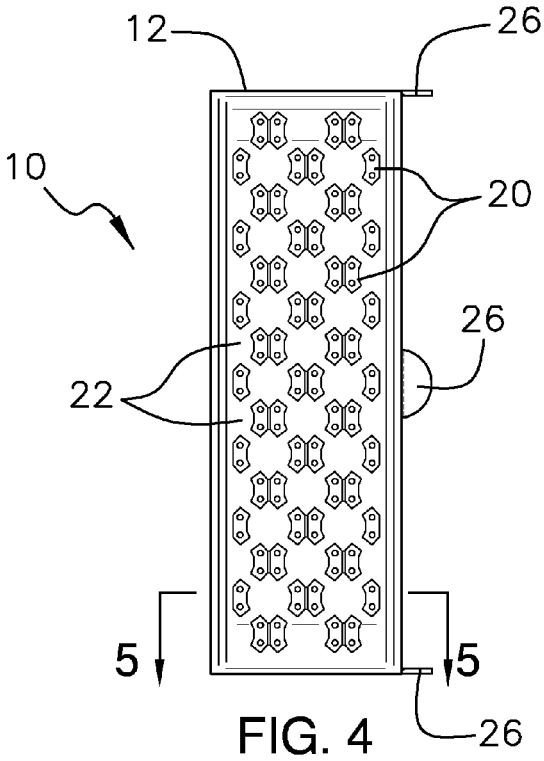
FIG. 4 is a front plan view of the invention.
Figure 5:
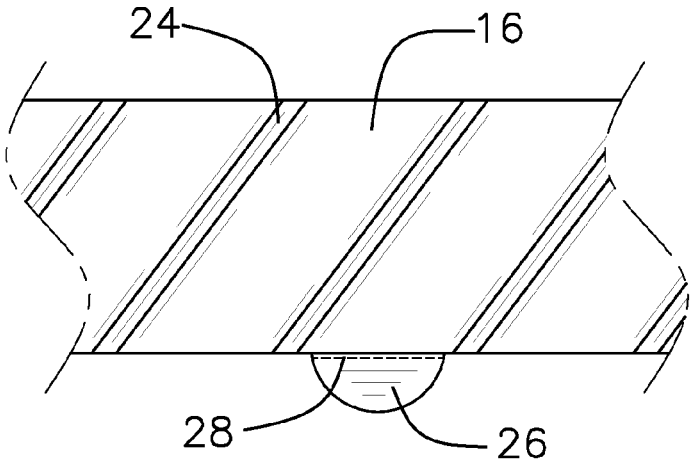
FIG. 5 is a fragmentary view of an inner panel of the present invention.

In reference to FIGS. 1 and 2, the invention, denoted generally by reference numeral 10, is shown mounted on a tire. The invention can be mounted on a smooth or treaded tire and provides traction for the vehicle to eliminate tire spin in mud. By eliminating the unnecessary spinning the battery power is preserved. The invention 10 comprises a band 12 having an outer panel 14, an inner panel 16 and a circular perimeter planer surface 18. The band 12 is formed of elastomeric material, such as rubber, and is dimensioned in circumference to snugly mount on the tires of a child's toy vehicle. It should be noted that in addition to providing additional traction for the wheels, that the band 12 prevents wear and tear on the tires and allows usage of tires that have been damaged.

Radially outwardly depending treads 20 formed of resilient material having recessed grooves 22 formed between the treads 20 are provided on the outer circumference of the outer panel 14. The treads 20 come into contact with the ground surface and work in concert with the wheels of the vehicle. The grooves 22 may extend circumferentially or laterally in a straight, curved or zig-zag manner.

Figure 6:
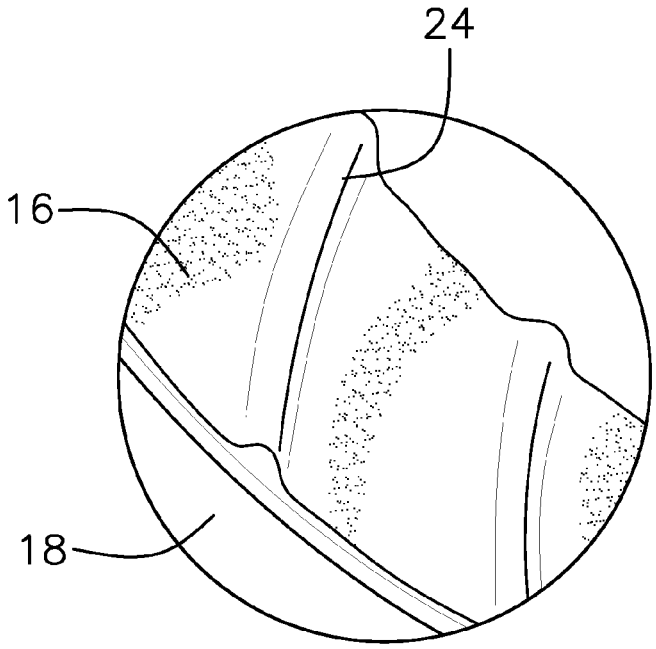
FIG. 6 is a fragmentary view of raised traction support members.

As illustrated in FIGS. 2 and 6, a plurality of spaced apart raised traction support members 24 is formed on the inner panel 16 of the band 12. The members 24 are composed of rubber and engage with the surface of the wheels of the toy vehicle and provide additional traction capability. The traction support members 24 are not limited to any specific configurations, and come in a variety of oriented arrangements, indentations and contact surface prominences.

Detachable grasping tabs 26, generally C-shaped, are connected to the circular perimeter planer surface 18 at predetermined locations. The tabs 26 have a scored segment 28 oriented parallel to the planer surface 18 preformed at a border of the planer surface 18 and the tabs 26. There are preferably four tabs 26 being approximately 3 inches in circumference which are used to pull the band 12 onto the tires. The segment 28 can be cut and the tabs 26 removed from the band 12 after installation.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tire tread attachment for use on a tire of a child's toy vehicle, comprising in combination:

a band having an outer panel, an inner panel and a circular perimeter planer surface;

a plurality of radially outwardly depending treads having recessed grooves formed on an outer circumference of the outer panel;

a plurality of raised traction support members formed on the inner panel; and grasping tabs integrally formed on the circular perimeter planer surface of the band, whereby the tabs have a scored section oriented parallel to the planer surface that can be cut and detach the tabs from the band.

* * * * *